US006454586B1

(12) United States Patent
Billman

(10) Patent No.: US 6,454,586 B1
(45) Date of Patent: Sep. 24, 2002

(54) CONNECTOR HAVING MOVEABLE INSERT

(75) Inventor: Timothy B. Billman, Dover, PA (US)

(73) Assignee: Hon Hai Precision Ind. Co., Ltd., Taipei Hsein (TW)

( * ) Notice: Subject to any disclaimer, the term of this patent is extended or adjusted under 35 U.S.C. 154(b) by 0 days.

(21) Appl. No.: 09/932,021

(22) Filed: Aug. 17, 2001

(51) Int. Cl.[7] ..... H01R 13/631
(52) U.S. Cl. ..... 439/260; 439/607; 439/108
(58) Field of Search ..... 439/260, 607–610, 439/108, 101, 65

(56) References Cited

U.S. PATENT DOCUMENTS 3,130,351 A * 4/1964 Giel
3,665,370 A * 5/1972 Hartmann ..... 439/260
4,556,268 A * 12/1985 Noschese ..... 439/267
5,785,534 A * 7/1998 Longueville et al. ..... 439/65
5,823,823 A * 10/1998 Longueville et al. ..... 439/571
6,012,927 A * 1/2000 Longueville et al. ..... 439/65
6,206,713 B1 * 3/2001 Baertsoen et al. ..... 439/260

* cited by examiner

*Primary Examiner*—Gary F. Paumen
(74) *Attorney, Agent, or Firm*—Wei Te Chung

(57) ABSTRACT

An electrical connector (100) includes an insulative housing (10) defining a slot (12), a row of low-speed signal contacts (18) and an insert module (16) received in respective opposite sides of the slot. The insert module has rows of high-speed signal contact (27) confronting the row of low-speed signal contacts. The insert module is pivotable in the slot from a first position, where the connector is ready for receipt of a daughter board (70), to a second position, where the insert module and the row of low-speed contacts sandwich the daughter board therebetween.

1 Claim, 10 Drawing Sheets

CONNECTOR HAVING MOVEABLE INSERT

CROSS REFERENCE TO RELATED APPLICATIONS

This application relates to U.S. patent application Ser. No. 09/893,810, filed Jun. 27, 2001, and U.S. patent application Ser. No. 09/904,353, filed Jul. 11, 2001, and an application filed on Aug. 17, 2001 with an unknown serial number titled "BACKPLANE CONNECTOR" having the same inventor and the same assignee with the instant application.

BACKGROUND OF THE INVENTION

1. Field of the Invention

The present invention relates to a connector, and particularly to an InfiniBand backplane connector mountable on a mother board and accommodating a daughter board therein, thereby establishing an electrical connection between the mother board and the daughter board.

2. Description of the Related Art

Today's computing model is becoming more distributed as companies work to meet the growing demands of the Internet economy. The demands of the Internet and distributed computing are challenging the scalability, reliability, availability, and performance of servers. To meet this demand a balanced system architecture with equally good performance in the memory, processor, and input/output (I/O) subsystems is required. Seven of the computing industry's leaders, Compaq, Dell, Hewlett-Packard, IBM, Intel, Microsoft and Sun Microsystems, have joined together to address this important issue by leading an independent industry body called the InfiniBand$^{SM}$ Trade Association. The association is dedicated to developing a new common I/O interconnect standard. On Oct. 24, 2000, the association released the version 1.0 of the InfiniBand Architecture Specification which discloses a rudiment of an InfiniBand backplane connector in the chapter 10 thereof.

The disclosed InfiniBand backplane connector is a low insertion force connector with two sets of contacts. One set of contacts, accommodated in an insulative module, is used on the primary side of the InfiniBand board for high-speed differential pair signals and its corresponding grounding. A second set of contacts, accommodated in another insulative module, is used on the secondary side of the board for low-speed signals, power, and grounding. The 12X type connector contains 24 pairs of high-speed contacts (48 pins) and 18 low-speed/power contacts. Closure of the mechanism to engage the high-speed contacts is achieved by an internal mechanism which is actuated by outline features on a paddle guard. U.S. Pat. No. 6,206,713, assigned to Tyco, and U.S. Pat. No. 5,785,534, 5,823,823 and 6,012,927, assigned to Siemens, disclose similar backplane connectors.

However, in the disclosed connector, two insulative modules are moved together to make the electrical connection. Apparently, the connection is not reliable as both insulative modules are moveable. The disclosed InfiniBand backplane connectors do not have means for driving the insulative module having the high-speed contacts to pivotably move toward the InfiniBand board or the driving means is not durable enough, so the normal force between the high-speed contacts and the InfiniBand board may be deficient, thereby affecting signal transmission between the InfiniBand connector and the InfiniBand board. Hence, an improved InfiniBand connector is desired.

SUMMARY OF THE INVENTION

An object of the present invention is to provide a backplane connector having a pivotable insert module for ensuring electrical connection between contacts of the connector and solder pads on an inserted daughter board.

To achieve the above mentioned object, an electrical connector includes an insulative housing defining a slot, a row of low-speed signal contacts and an insert module received in respective opposite sides of the slot. The insert module has rows of high-speed signal contact confronting the row of low-speed signal contacts. The insert module is pivotable in the slot from a first position, where the connector is ready for receipt of a daughter board, to a second position, where the insert module and the row of low-speed contacts sandwich the daughter board therebetween.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
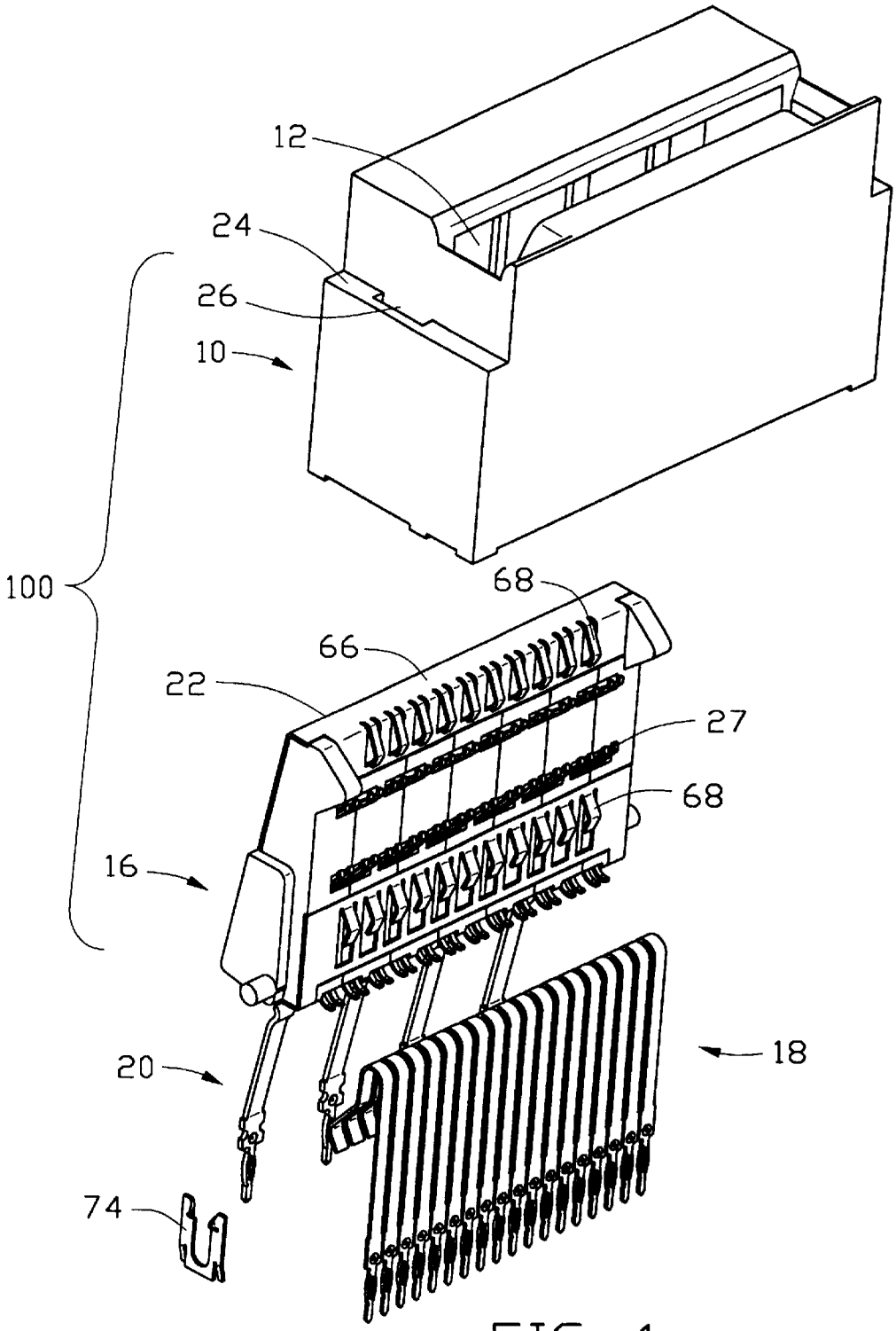
FIG. 1 is an exploded, perspective view of an electrical connector according to the present invention as seen from a right-top perspective.
Figure 2:
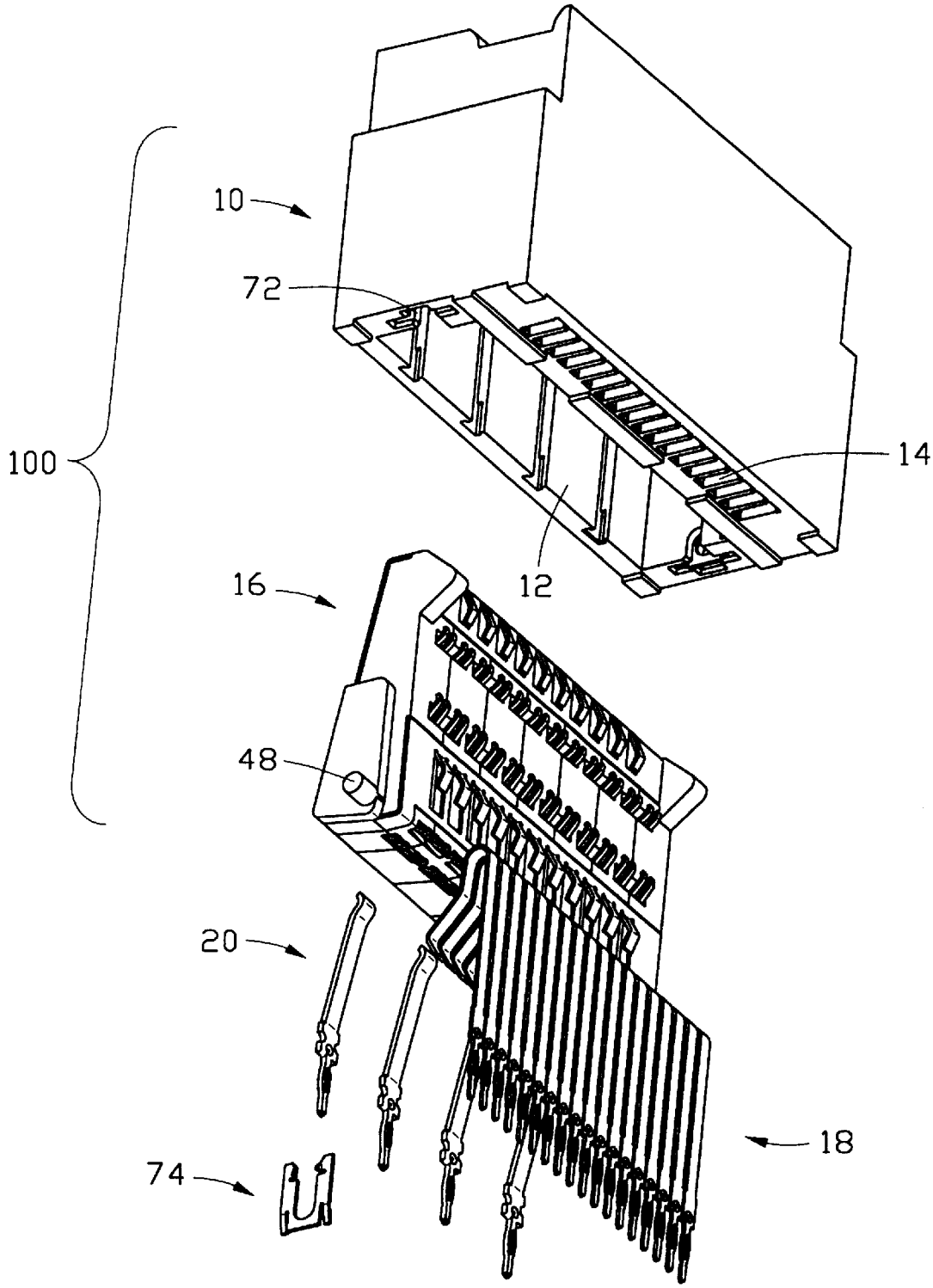
FIG. 2 is a view similar to FIG. 1 but seen from a right-bottom perspective.

Referring to the drawings in great detail, and first to FIGS. 1 and 2, an electrical connector 100 includes an insulative housing 10 defining a slot 12 and a plurality of cavities 14 through top to bottom thereof, an insert module 16 moveably received in the slot 12, a plurality of first signal contacts 18, generally low-speed signal contacts, retained in the respective cavities 14 and a plurality of, for example four, spring terminals 20, generally grounding contacts, located behind the insert module 16 for pressing a top portion 22 of the insert module 16 toward the first signal terminals 18. The insert module 16, the first signal contacts 18 and the spring terminals 20 are inserted in the slot 12 of the housing 10 from the bottom of the housing 10. The housing 10 has preferably a shoulder 24, defining a slit 26, at each of opposite lateral ends thereof. The shoulders 24 are engageable with fasteners or latching means (not shown) adapted for being fastened to a printed circuit board (PCB) 30 (FIG. 8) for retaining the electrical connector 100 to the PCB 30. Of course, the shoulders 24 and the fasteners or latching means may be omitted in certain situations. The insert module 16 maybe integrally formed by insert-molding two rows of high-speed signal contacts 27. In the instant invention, the insert module 16 is preferably includes a number of sub-modules and a number of contact modules sandwiched between the sub-modules therein.

Figure 4:
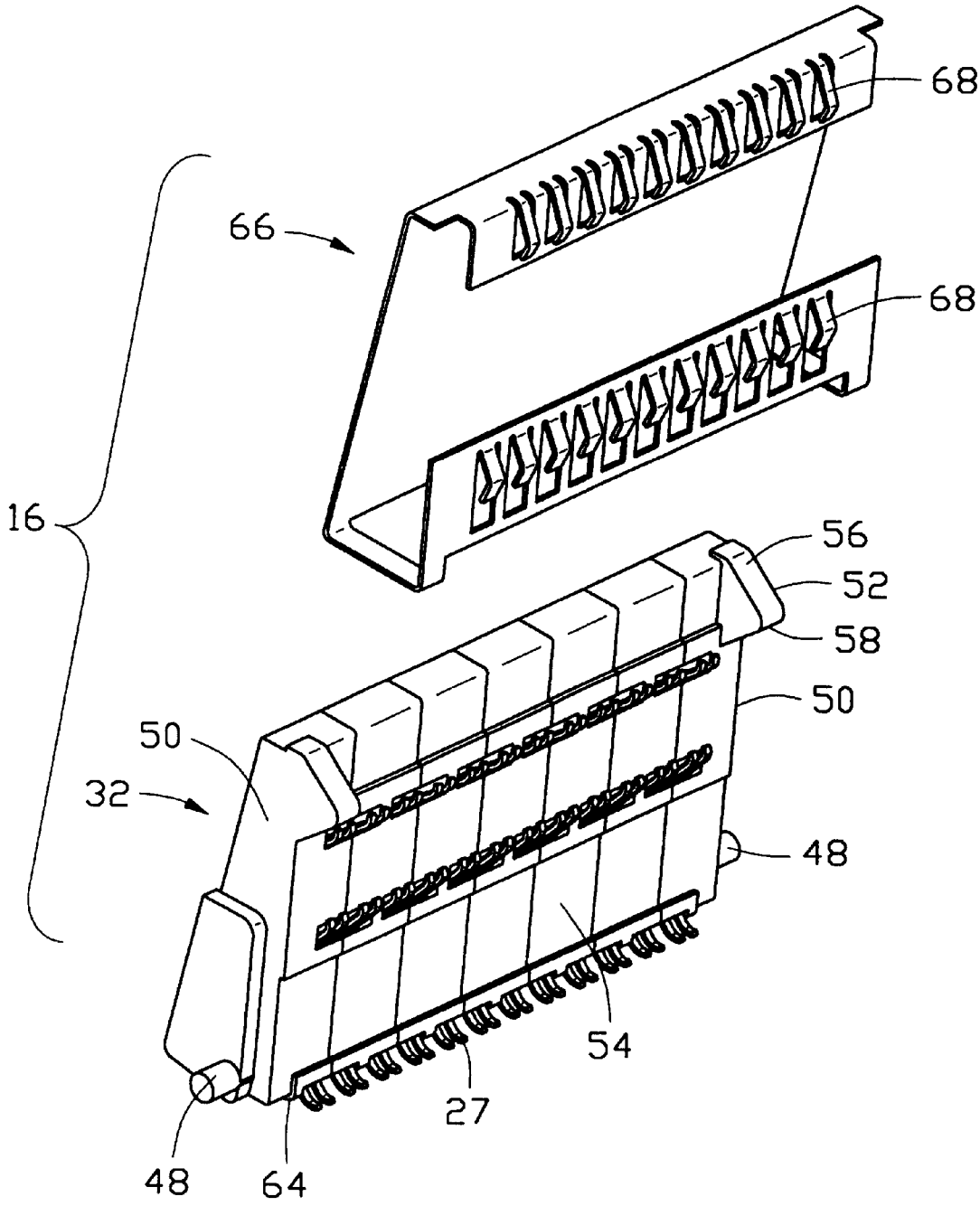
FIG. 4 is a partially exploded, perspective view of an insert module in FIGS. 1 and 2.
Figure 5:
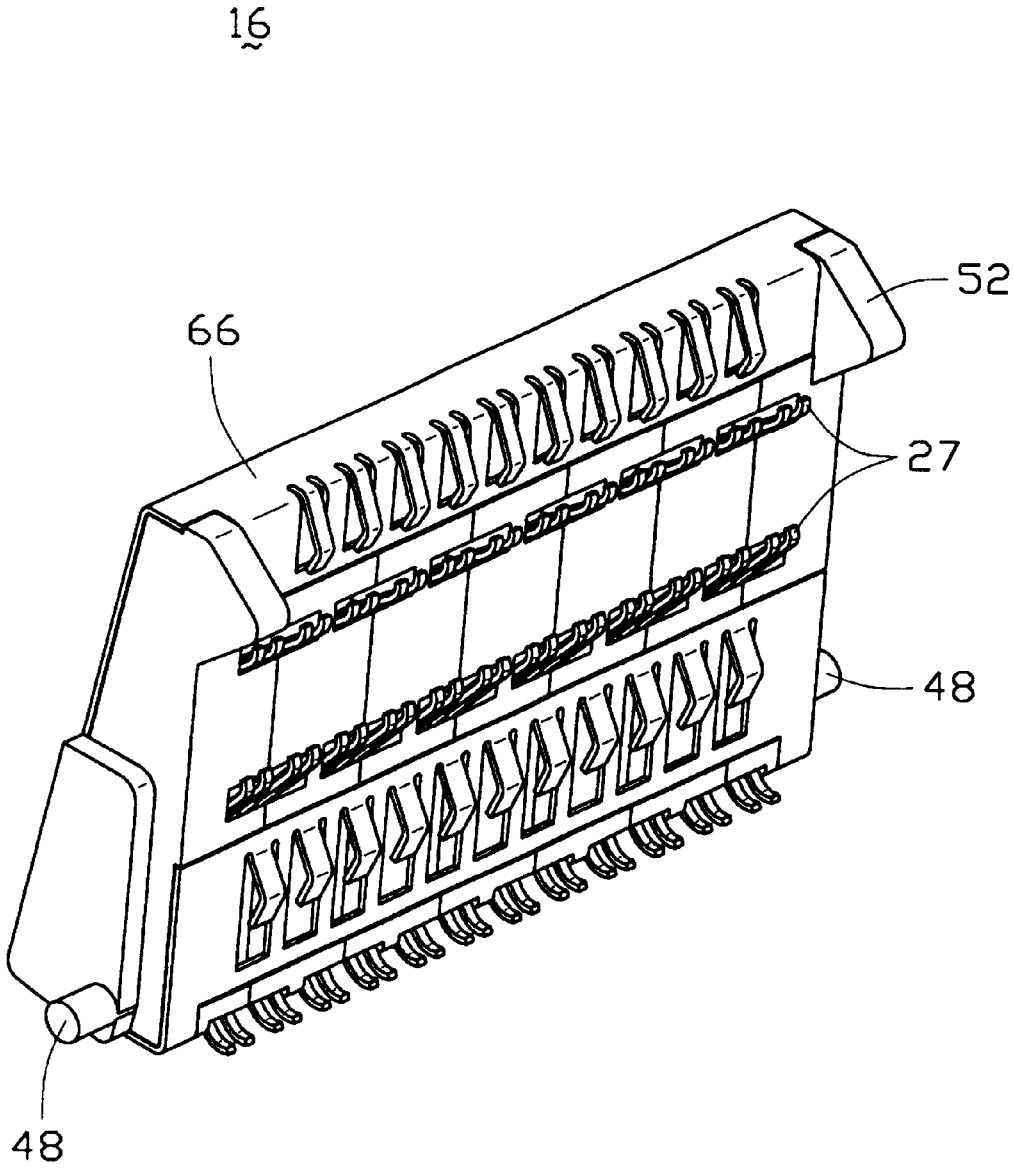
FIG. 5 is a perspective view of the assembled insert module in FIG. 4.
Figure 7:
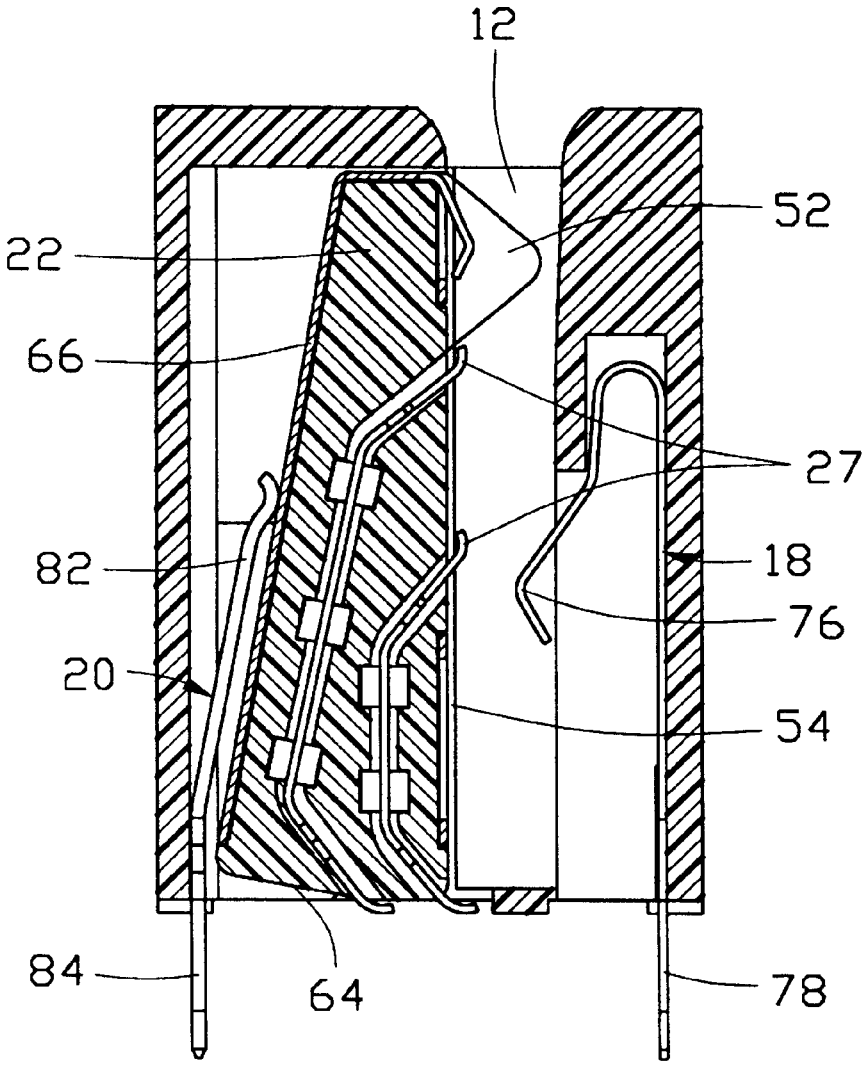
FIG. 7 is a cross-sectional view of the connector in FIG. 6 taken from the cut-away end of the insulative housing.

Referring to FIG. 4, particularly, the insert module 16 includes an insulator 32, two rows of high-speed signal contacts 27,and a metal shield 66. The insulator 32 has a pivot 48 on each outer side face 50 and a pair of protrusions 52 at a top portion of an inner face 54 thereof. The protrusion 52 has an upper inclined surface 56 and a lower inclined surface 58. The contacts 27 are formed within the insulator 32 with ends of the high-speed signal contacts 27 respectively extending beyond the inner face 54 and a bottom face 64 of the insulator 32 (FIG. 7). The metal shield 66 is applied to and wraps around the insulator 32. The metal shield 66 has a plurality of spring tabs 68 for attaching to grounding trails on a daughter board 70 (FIG. 9) to establish a grounding path. FIG. 5 shows the completely assembled insert module 16.

Figure 3:
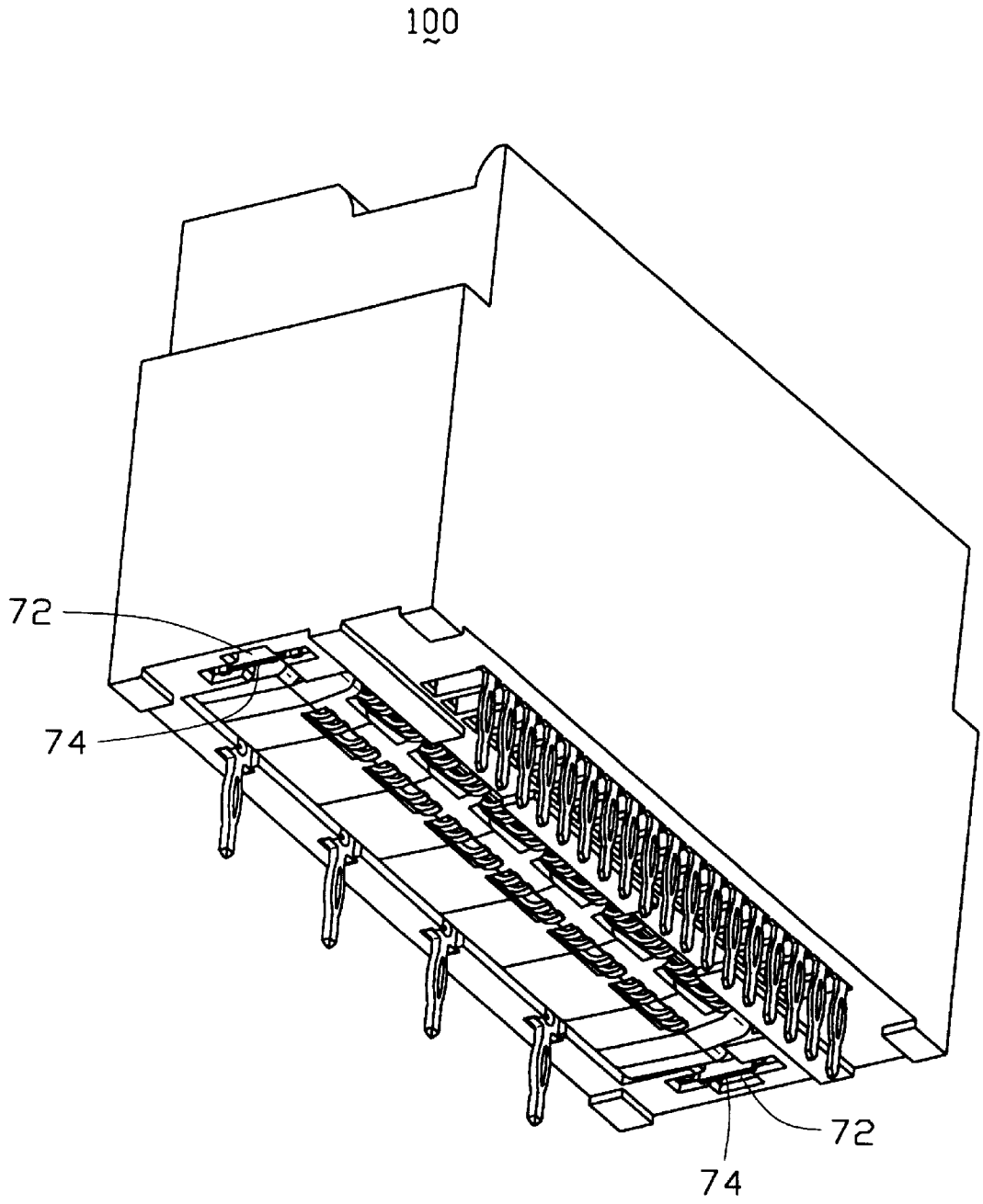
FIG. 3 is an assembled view of the electrical connector in FIG. 2.
Figure 6:
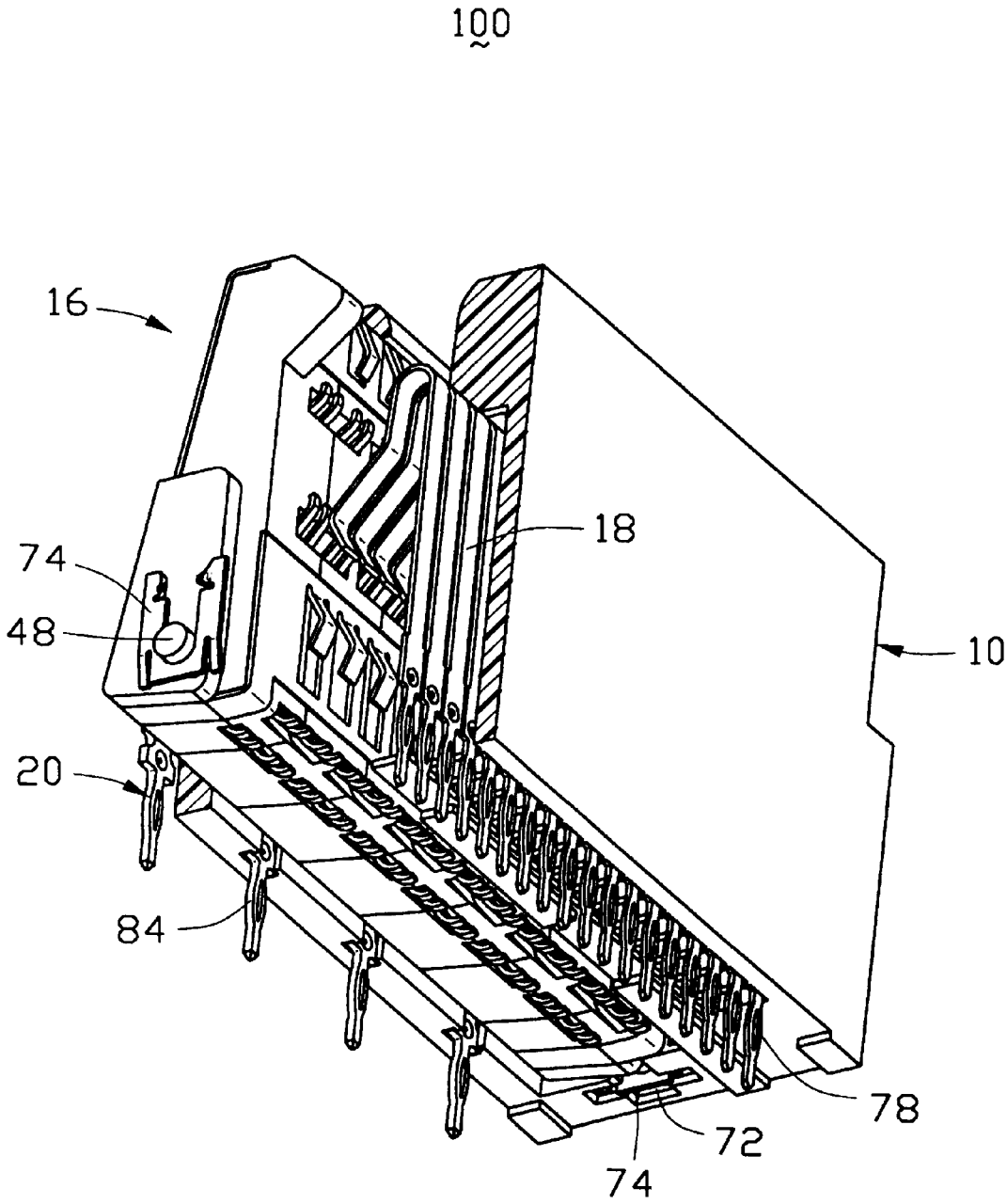
FIG. 6 is a view similar to FIG. 3 except that an end of an insulative housing of the connector is cut-away to clearly show the insert module and a number of low-speed signal contacts in the insulative housing.
Figure 8:
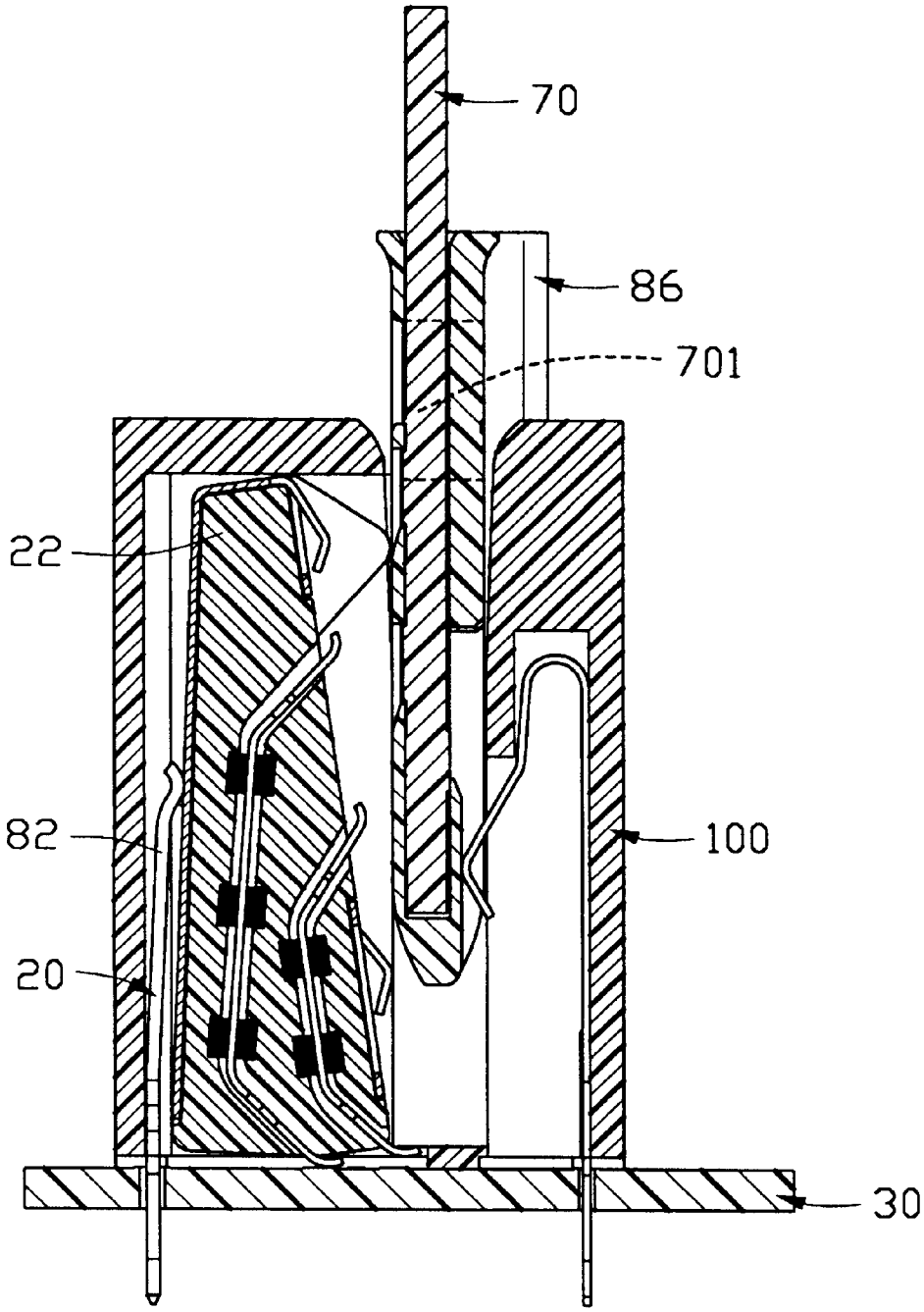
FIG. 8 is a view similar to FIG. 7 expect that an edge of an electronic device is inserted in a slot of the connector at a three-quarter depth of the slot.

Referring to FIGS. 6 and 7, the insert module 16 is rotatably received in the slot 12 of the housing 10 and the pivots 48 of the insert module 16 are pivotably received in grooves 72 (FIGS. 2 and 3)of the respective lateral walls of the housing 10. A pair of U-shaped metal clips 74 are fixedly inserted in respective grooves 72 to hold the pivots 48 in the respective grooves 72 to prevent downward movement of the insert module 16 from the housing 10. Each first signal contact 18 includes a contact portion 76 extending into the slot 12 of the housing 10 and a press-fit foot 78 extending beyond the bottom face of the housing 10 for connection to the PCB 30 (FIG. 8). The four spring terminals 20 are positioned between the insert module 16 and a rear wall of the housing 10. Each spring terminal 20 has a spring contact arm 82 pressing against the metal shield 66 to drive the top end 22 of the insert module 16 toward the first signal contacts 18 and a press-fit tail portion 84 extending beyond the bottom face of the housing 10 for connection to the PCB 30 (FIG. 8). In this institution, the protrusions 52 of the insert module 16 protrude into the slot 12 of the housing 10.

Figure 9:
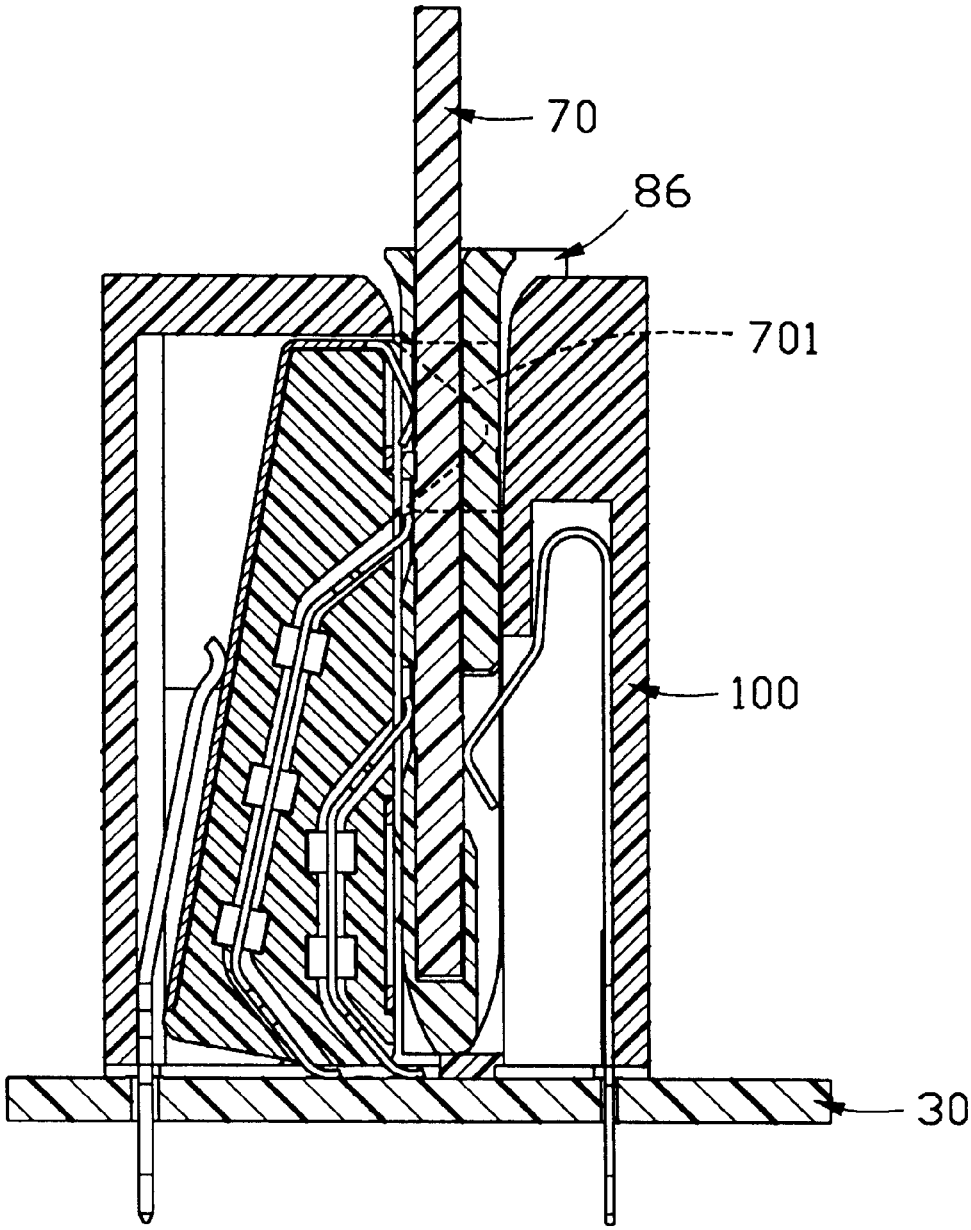
FIG. 9 is a view similar to FIG. 8 except that the electronic device is inserted in the slot of the connector at a full depth of the slot.
Figure 10:
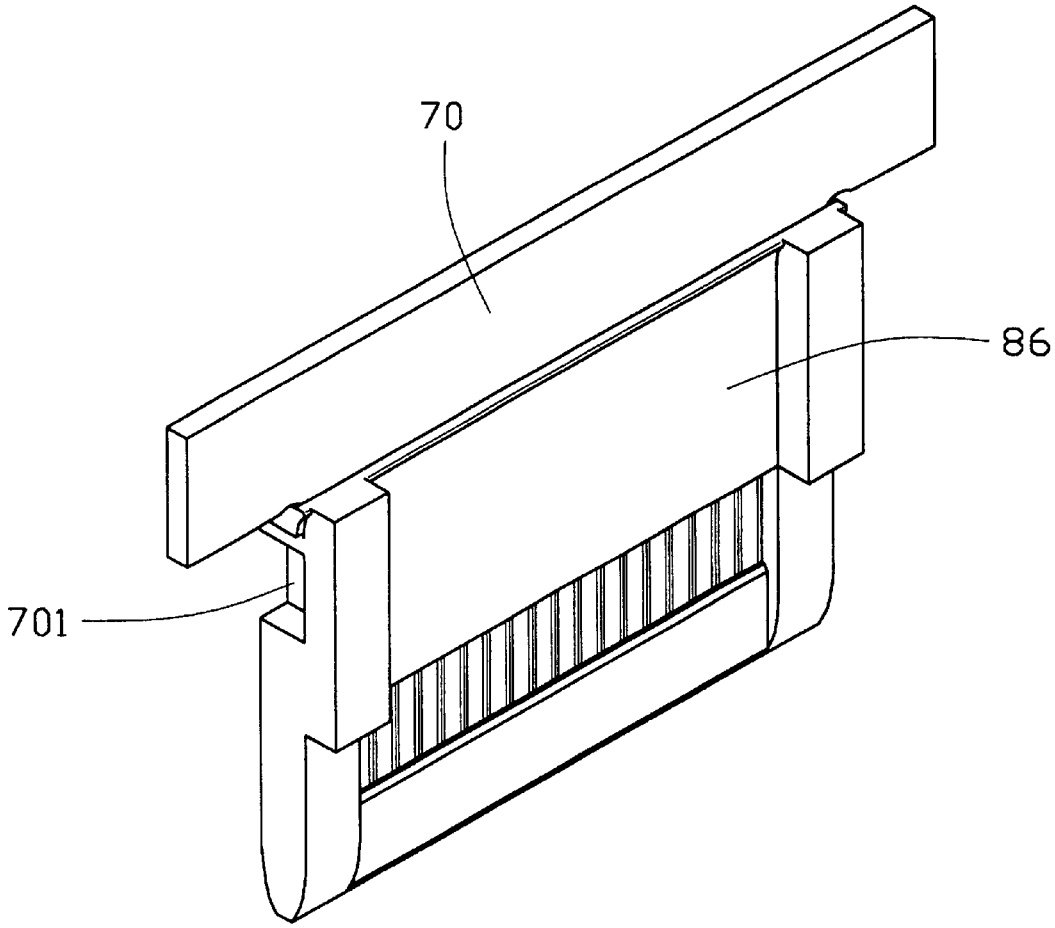
FIG. 10 is a perspective view of a daughter board.

Referring to FIGS. 8 and 9, particularly, when the daughter board 70, shrouded by a paddle guard 86 at one edge of the daughter board 70, is inserted into the slot 12 of the housing 10 to electrically engage with the connector 100 mounted on the PCB 30, a tip of the paddle guard 86 bears against the protrusions 52 of the insert module 16 and presses the insert module 16 to rotate about the pivots 48 counterclockwise. The daughter board 70 further defines two openings 701 in opposite edges which are dimensioned to receive the protrusion 52 of the insulator 32 therein. After the daughter board 70 is adequately inserted into the slot 12, the tip of the paddle guard 86 is stopped by the bottom of the housing 10 and the protrusions 52 go to corresponding openings 701 of the daughter board 70 and the paddle guard 86. The insert module 16 rotates clockwise about the pivots 48 thereof under the pressure of the spring contact arms 82. The contact portions 76 of the low-speed signal contacts 18 electrically contact solder pads on the daughter board 70 and the distal ends of the high-speed contacts 27 in the insert module 16 electrically contact solder pads on an opposite surface of the daughter board 70, thereby electrically connecting the daughter board 70 with the PCB 30.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly including a motherboard, a connector and a daughter board, the connector comprising:

an insulative housing having a front wall, a back wall, two opposite side walls, a top face, a bottom face and a slot defined through the top and bottom faces;

an insert module pivotably received in the slot of the housing, the insert module having an insulator and a plurality of conductors retained to the insulator; and a plurality of spring terminals located within the slot of the housing and urging the insert module to pivot in the slot; one end of each conductor electrically contacting the motherboard, the daughter board being insertable into the slot to electrically contact another end of each conductor.

further comprising a plurality of contacts fixedly retained to the front wall, each first contact having a contact portion for electrically contacting the daughter board and a foot for being mounted on the motherboard;

wherein each conductor comprises opposite ends respectively extending beyond an inner face and a bottom face of the insulator;

wherein the insulator comprises a pair of pivots each on an outer side face and a pair of protrusions at a top portion of the inner face;

wherein the daughter board comprises a paddle guard shrouding the daughter board and two openings defined in opposite edges thereof, each opening being dimensioned to receive a corresponding protrusion of the insulator therein;

further comprising a metal shield shrouding the insert module, and wherein the spring terminals electrically contact the metal shield.

* * * * *